United States Patent [19]

Burrows

[11] 3,981,089

[45] Sept. 21, 1976

[54] PADDING MACHINES

[76] Inventor: Norman Bruce Burrows, Rte. 2, Box 3109, Odessa, Tex. 79763

[22] Filed: Oct. 6, 1975

[21] Appl. No.: 619,948

[52] U.S. Cl. ..... 37/142.5; 214/83.36; 214/518; 214/82

[51] Int. Cl.[2] ..... E02F 5/22

[58] Field of Search ..... 214/518–522, 214/83.36, 82; 37/7, 8, 126, 129, 142.5; 61/72.1, 72.5

[56] References Cited

UNITED STATES PATENTS

| | | | |
|---|---|---|---|
| 2,694,499 | 11/1954 | Mohrlang et al. | 214/518 |
| 2,931,529 | 4/1960 | Osterhaus | 214/519 |
| 3,314,175 | 4/1967 | Petty et al. | 37/108 R |
| 3,396,481 | 8/1968 | Hovorak | 37/8 X |

*Primary Examiner*—Albert J. Makay
*Attorney, Agent, or Firm*—Marcus L. Bates

[57] ABSTRACT

A machine for distributing padding material within a previously dug ditch so that a pipe placed within the ditch is protected from objectionable objects which may otherwise cause damage thereto.

The padding machine comprises an earth moving vehicle having a laterally arranged conveyer means connected thereto, so that padding material can be transported laterally away from the vehicle and into a ditch while the machine travels along a parallel path respective to the ditch.

15 Claims, 7 Drawing Figures

PADDING MACHINES

BACKGROUND OF THE INVENTION

Cross-country pipelines are extremely expensive to construct and must therefore be designed to retain their structural integrity for many years if the initial cost thereof is to be recouped. The exterior of the pipe is usually wrapped with a protective covering, which insulates the pipe from moisture and prevents the occurrence of electrolysis, thereby greatly minimizing corrosion thereof. Should the outer surface of the pipe inadvertently contact a sharp object, such as a rock, repeated movement of the pipe due to thermal expansion will soon abrade away the covering, and eventually expose the exterior metallic surfaces of the pipe to the deleterious effects of ambient. Subsequently, corrosive action and various other chemical reactions commence, and eventually the pipe must be uncovered and repaired. This is an expensive endeavor which can only be avoided by initially padding the entire outer peripheral surface of the pipeline with a suitable padding material. The padding material is usually comprised of sand or other earthen products, such as finely commuted limestone.

Heretofore it has been necessary to dig the pipeline ditch in such a manner that the excavated earth is placed in a coextensive line to one side thereof, and thereafter the opposed side of the ground contiguous thereto is scraped free of debris. Next, a continuous line of suitable padding material is spread on the cleansed area adjacent to the ditch so that earth handling vehicles, such as a maintainer, can subsequently "blade" a portion of the deposited padding material into the ditch. After the pipe has been positioned within the ditch where it is laid upon the padding material, the maintainer must again scrape another portion of the remaining padding material onto the top of the pipe. A generous portion of the padding material is deliberately left behind to minimize the probability of inadvertently scraping rocks and other harmful debris onto the top of the pipe.

The above-described prior operation is costly because it fails to utilize all of the padding material. Furthermore, the padding material is never uniformly distributed. Moreover, wind or rainstorms will often scatter the stored padding material, causing portions of the operation to be repeated.

Accordingly, it is desirable to have made available a padding machine within which padding material can be stored for transporting, thereby enabling the machine to travel parallel and adjacent to a pipeline ditch in such a manner that padding material can be translocated directly from the vehicle into the ditch where the pipe is padded in a uniform and optimum manner.

This expedient eliminates the waste involved in the above-described prior art operation; and furthermore, more efficiently pads or insulates the pipe in a rapid and relatively inexpensive manner.

SUMMARY OF THE INVENTION

This invention encompasses improvements in padding machines for distributing padding material within a previously dug ditch. The padding machine is in the form of an earth moving vehicle having a container within which padding material is stored so that it can be transported and subsequently dispensed therefrom. A movable wall of the container forces the material toward an opposed vertically movable wall. The vertically movable wall cooperates with the container interior to form an outlet in the form of a valve means through which a controllable flow of padding material occurs.

A laterally arranged conveyor system receives padding material from the valve and transports the material to a dumping location along side the machine. The machine can therefore continuously unload padding material into a ditch while the machine is driven parallel to and along side the ditch. The position of the movable walls and the speed of the conveyor are each controlled in a manner to uniformly cover the bottom of the ditch with the padding material in a new and unobvious manner.

Accordingly, a primary object of this invention is the provision of an improved padding machine which places padding material within a ditch.

An equally important object of this invention is to provide a method of transferring padding material from an earth moving vehicle into a previously dug ditch.

Another object of the invention is to provide a conveyor system for use in conjunction with an earth moving vehicle which enables the vehicle to be used as a padding machine.

A further object of this invention is to disclose and provide a conveyor system in combination with an earth moving vehicle which enables the vehicle to distribute padding material about a pipe located within a ditch.

A still further object ot this invention is to disclose and provide a removably mounted conveyor system mounted on an earth moving vehicle which conveys padding material laterally from the vehicle into a pipe line ditch lying parallel to the path of travel thereof.

Another and still further object of this invention is to provide a new combination of an earth moving vehicle and a conveyor system which enables padding material to be transferred directly from the vehicle interior into a ditch spaced therefrom as the vehicle travels in a direction parallel to the ditch.

An additional object of this invention is the provision of improvements in padding machines wherein a pipe lying in a ditch can be insulated with padding material in an unexpected and superior manner.

These and various other objects and advantages of the invention will become readily apparent to those skilled in the art upon reading the following detailed description and claims and by referring to the accompanying drawings.

The above objects are attained in accordance with the present invention by the provision of a combination of elements which broadly are fabricated in a manner substantially as described in the above abstract and summary.

DETAILED DESCRIPTION OF THE PREFERRED EMBODIMENTS

Throughout the various figures of the drawings, wherever it is possible or logical to do so, like or similar numerals refer to and identify like or similar parts.

Figure 1:
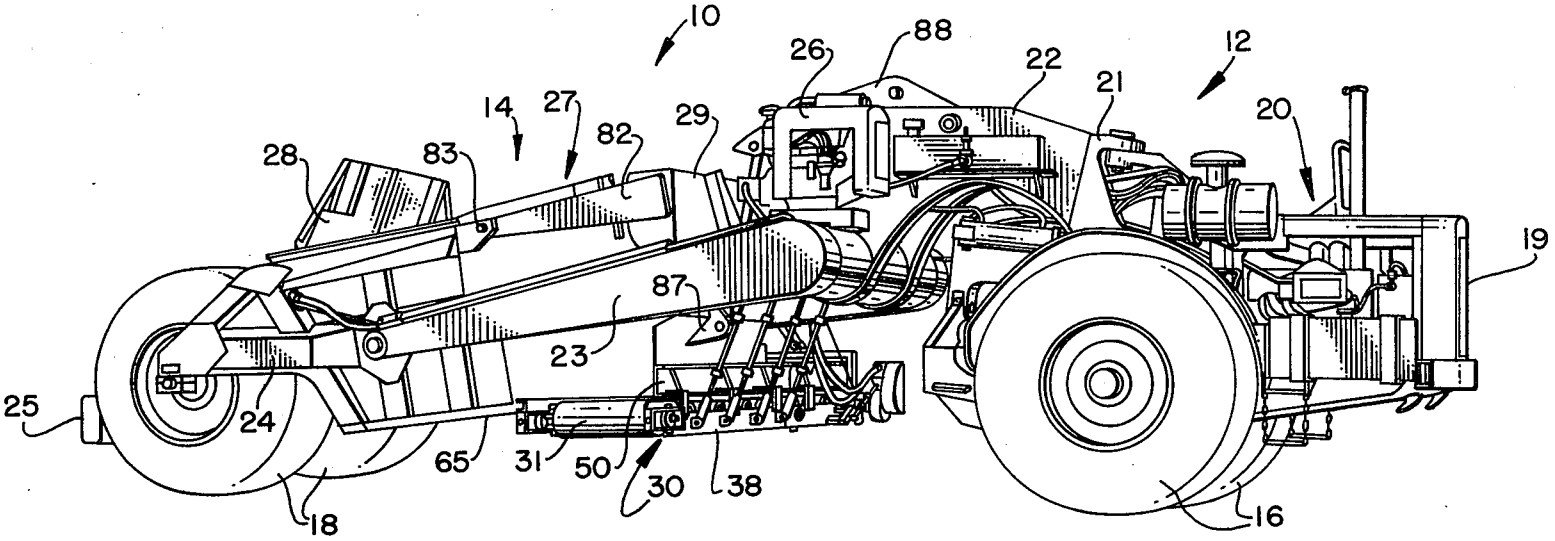
FIG. 1 is a perspective side view of a padding machine made in accordance with the present invention.

In FIG. 1 of the drawings, together with some of the remaining FIGS. thereof, there is disclosed a padding machine 10 made in accordance with the present invention. The machine is in the form of an earth moving vehicle and includes a prime mover section 12 which guidably propels a distributing section 14 thereof. The padding machine is ground supported by the illustrated front and rear pneumatic tires 16 and 18. The front end 19 of the machine is forwardly placed ahead of the driver, who is seated in the general area indicated by numeral 20.

Trunion 21 is journaled to the prime mover and forms the forward end portion of a monocoque spar 22. The spar 22 is bifurcated so that it supports a pair of parallel spaced main lateral support members 23. Rearwardly spaced apart support members 24 are journaled to a pair of tires 18 in the usual manner. Numeral 25 indicates a bumper which defines the rearwardmost portion of the machine.

An internal combustion engine 26 drives the illustrated hydraulic pump, so tht hydraulic power is available for the operation of the distributing section of the apparatus. The distributing section includes an upwardly opening container which admits padding material to be charged thereinto at 27. The container is defined by the illustrated fixed opposed side walls, a horizontally movable rear wall 28, and a vertically movable front wall 29.

A conveyor means 30 underlies the lower forward marginal end of the container and includes a charging end 31 and a delivery end 32.

Figure 3:
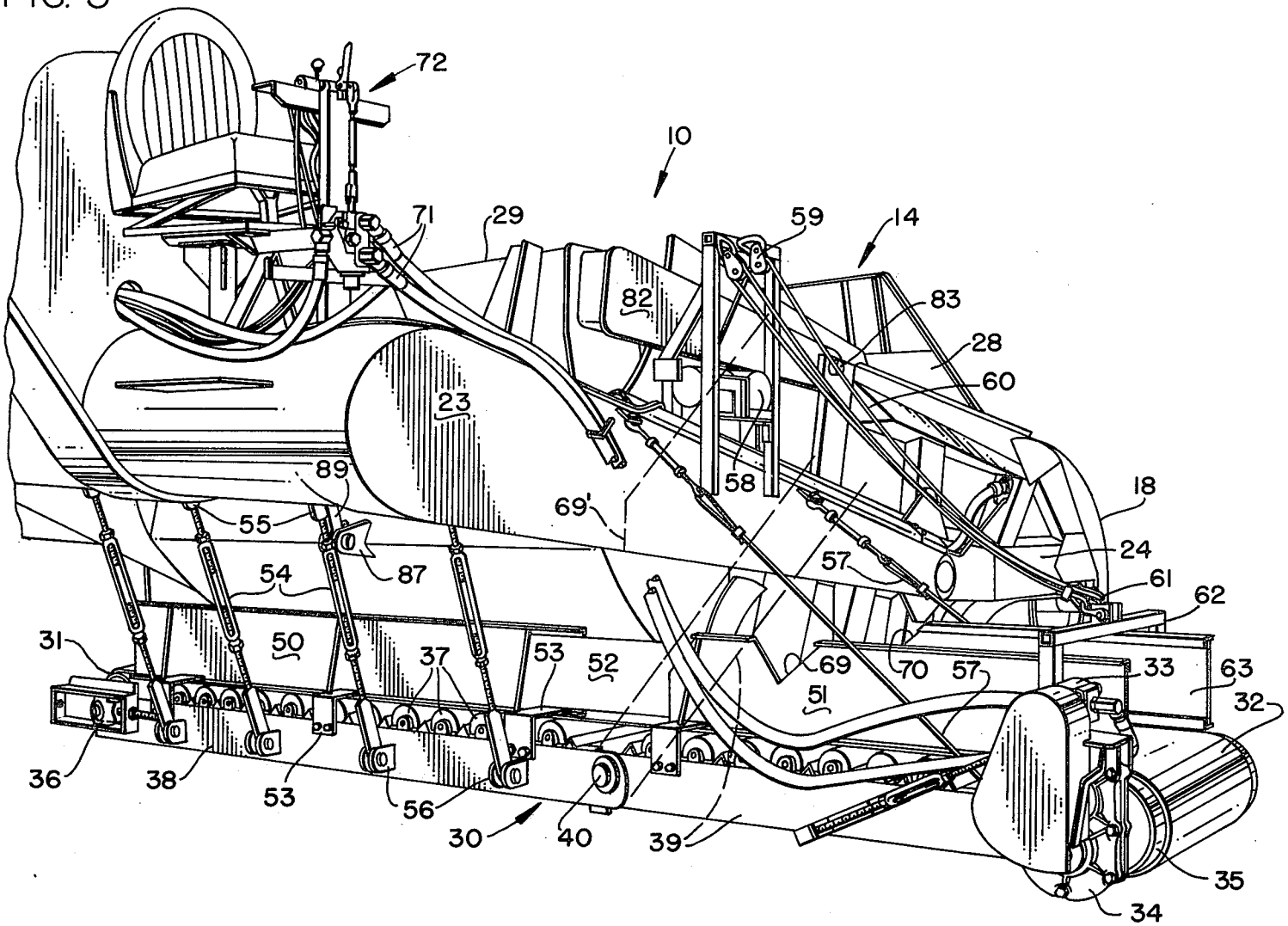
FIG. 3 in an enlarged, broken, perspective view which discloses the opposite side of the machine seen in FIGS. 1 and 2.
Figure 4:
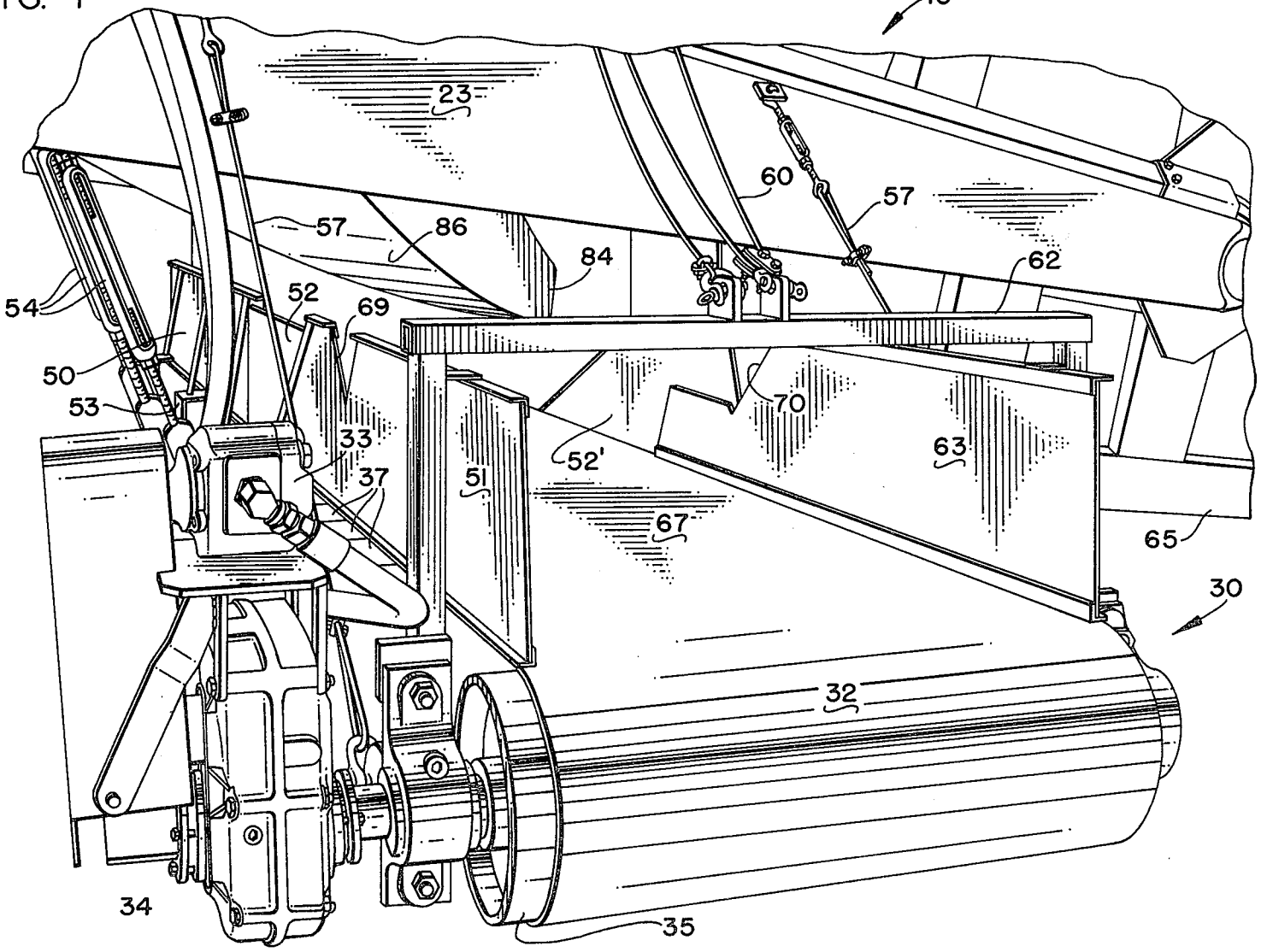
FIG. 4 is an enlarged, fragmentary, perspective detail of part of the apparatus disclosed in the foregoing figures.

As best seen illustrated in FIGS. 3 and 4, a hydraulic motor is housed at 33 and is operatively connected to a reduction gear assembly 34. The reduction gear assembly is connected to a powered roller 35 which forms the before-mentioned delivery end of the apparatus. The opposed end 31 of the conveyor is likewise provided with a roller having an adjustable journal means 36 associated therewith. Idler roller 37 are disposed at various intermediate locations between the opposed end rollers. The end rollers are held in spaced apart relationship by a pair of spaced beam members, one of which is seen at numeral 38.

The delivery end of the conveyor has a marginal portion 39 thereof journaled to the main support beam at pivot point 40 in such a manner that roller 35 can be pivoted thereabout so that marginal end 39 of the conveyor assumes almost a vertical position.

Figure 2:
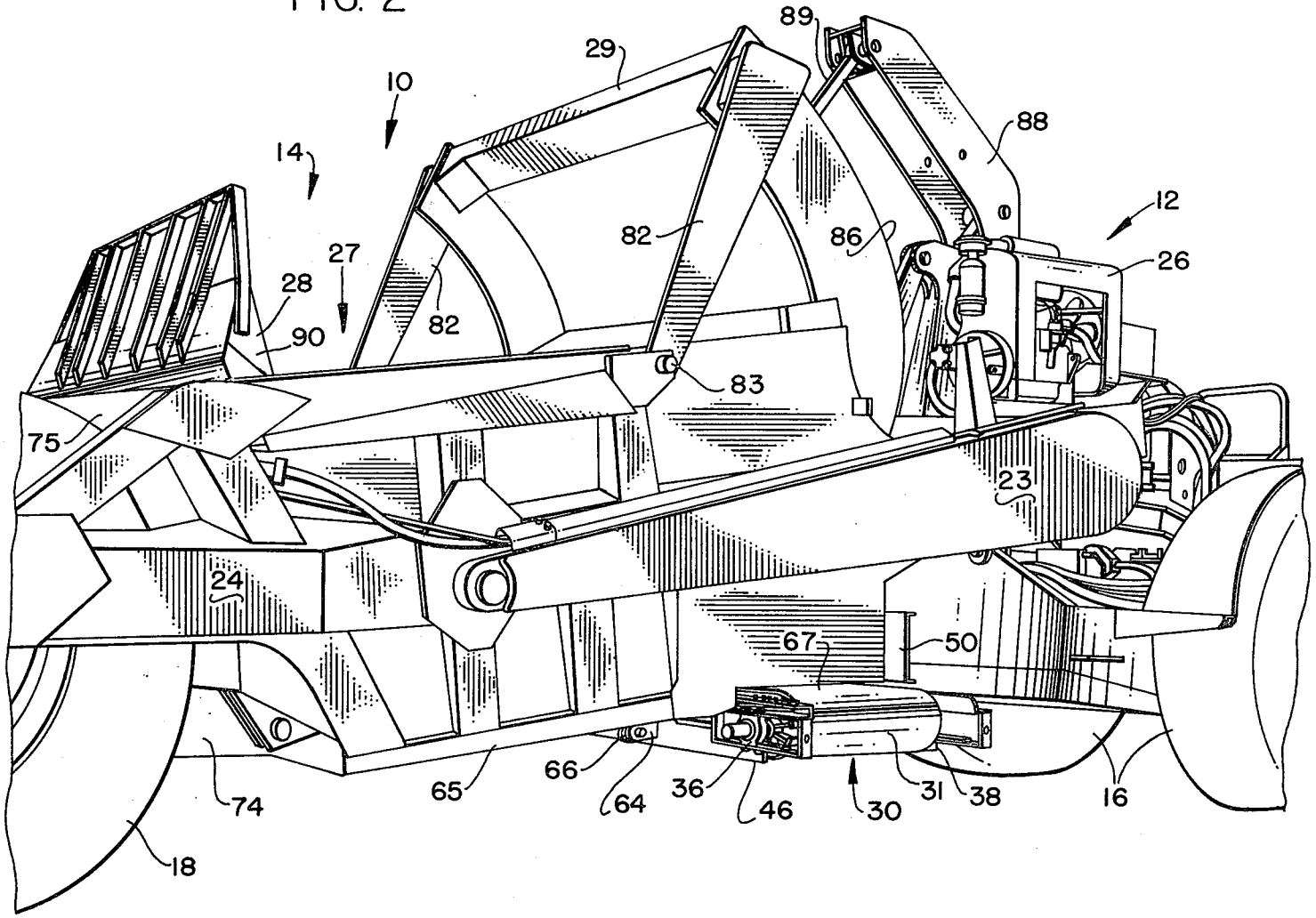
FIG. 2 is a broken, enlarged, perspective side view of the machine disclosed in FIG. 1.
Figure 5:
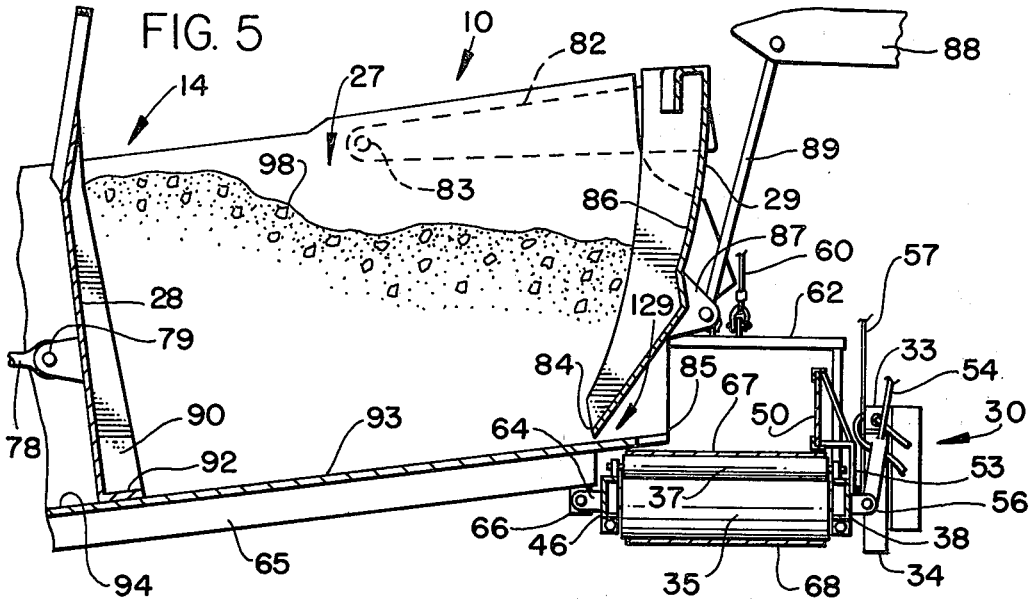
FIG. 5 is a broken, part cross-sectional, side view of part of the apparatus disclosed in the foregoing figures.
Figure 6:
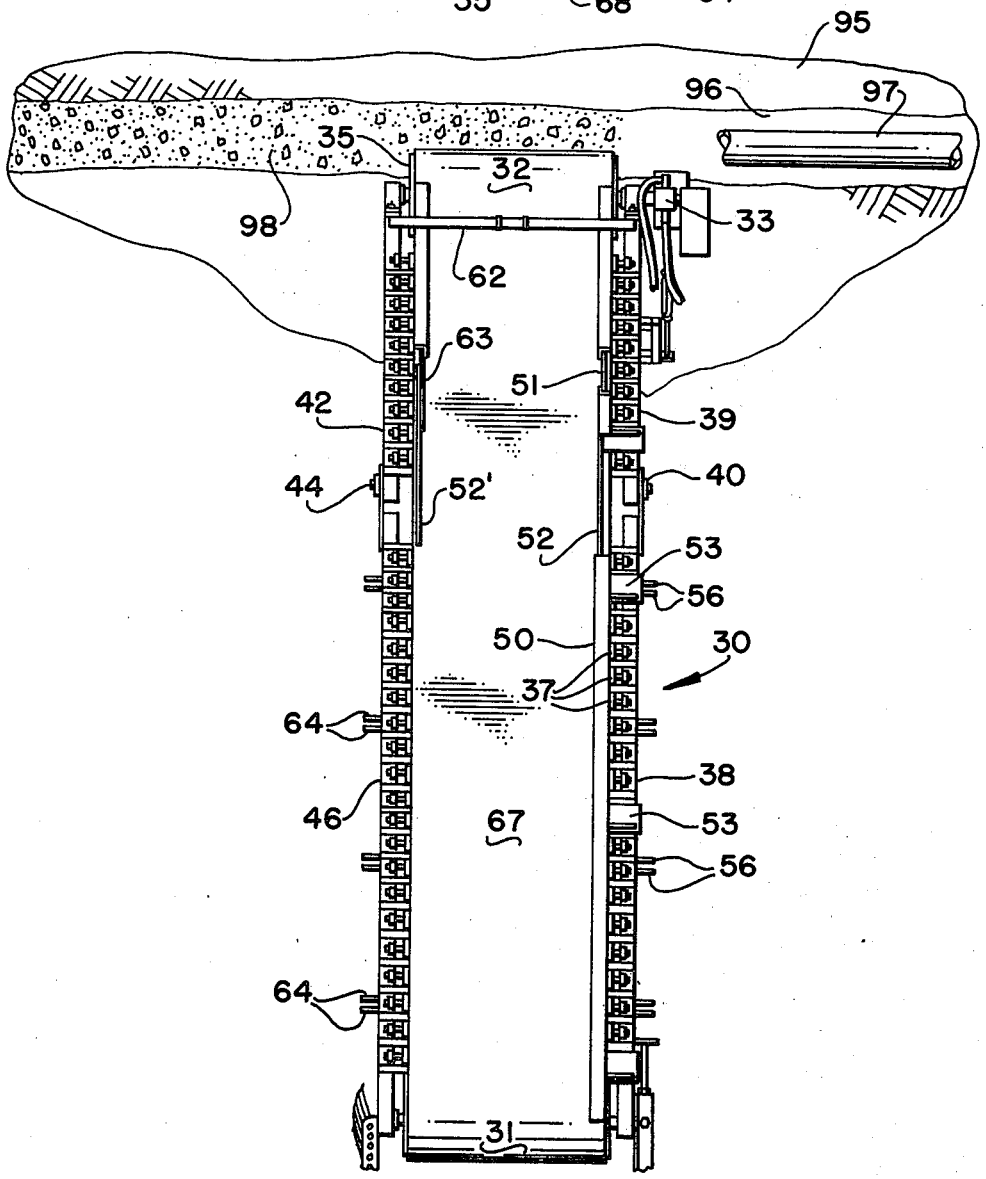
FIG. 6 is an isolated, top plan view of part of the apparatus disclosed in the foregoing figures; and, FIG. 7 is a broken top plan view which discloses some of the operative features of the apparatus disclosed in FIGS. 1 and 2.

As seen in FIGS. 2, 5, and 6, the conveyor includes members 42, 44, 46, which are opposed to the corresponding before mentioned members 38, 39, and 40.

As seen in FIG. 3, vertical side boards 50 and 51 prevent spillage of padding material from the top surface of the conveyor and are interconnected by a flexible, resilient, intermediate member 52. The member 52 preferably is in the form of a thick piece of rubber sheeting. The side boards are affixed to beams 38 and 39 by brackets 53. Adjustable elongated support members 54 preferably are in the form of a turnbuckle, and each are arranged at a suitable angle to connect the fixed beam 38 to the forward portion of the spar 23 by means of the attachment fittings seen illustrated at 55. The turnbuckles each have a lower end portion removably pinned to the illustrated forwardly disposed ears of brackets 56, so that removal of the pinns therefrom will permit the entire forward side 38 of the conveyor to be disconnected from the spar. Hence beams 38 and 39 can be rotated about the opposed coextensive beams 46 and 42.

The foldable or pivotal portion 39 of the conveyor is supported horizontally by a pair of adjustable guy wires 57. Winch motor 58 places tension on a cable 60, which is roved through an upper block member 59 and a lower block member 61. The lower block is affixed to a vertical standard 62, with the legs of the standard being rigidly affixed to the opposed beam members of the foldable portion 39 of the conveyer. The standard also lends support to the opposed side boards 51 and 63.

As seen in FIGS. 5 and 6, the rear beam 46 of the conveyor is provided with brackets or ears 64, similar to the before mentioned ears 56. The spaced apart ears 64 are pinned to the illustrated downwardly depending bracket 66 by the illustrated removable pin, so that when the pin is removed, the ears are disengaged from the bracket and the conveyor is released from the floor superstructure 65. The superstructure rigidifies the bottom of the container.

The conveyor includes an endless belt having an upper material receiving surface 67 and a lower surface 68. When end 32 of the conveyor is pivoted about pivot pin 40, cutout 69 receives the lower edge portion of the main body spar at 69' therewithin to thereby enable the effective width of the machine to be greatly reduced. The opposed side board is provided with a similar cutout 70. Flexible sideboard member 52' bridges the gap from cutout 70 to the container outlet. This particular mechanical expedient brings about an unusual attribute of the machine in that transportation from one to another geographical location is effected quickly and economically.

Quick disconnects 71 are of conventional design and enable the illustrated hydraulic hoses to be removed along with the conveyor, thereby enabling the entire conveyor to be rapidly removed from the remainder of the distributing section of the invention. This expedient further reduces the effective width of the machine and further enhances its relocation between job sites.

Control console 72 controls the flow of hydraulic fluid between the hoses connected at 71, thereby enabling the operator to control the speed with which the conveyor surface 67 moves. The console further controls other operative parameters of the distribution section as will be better appreciated later on in this disclosure.

Figure 7:
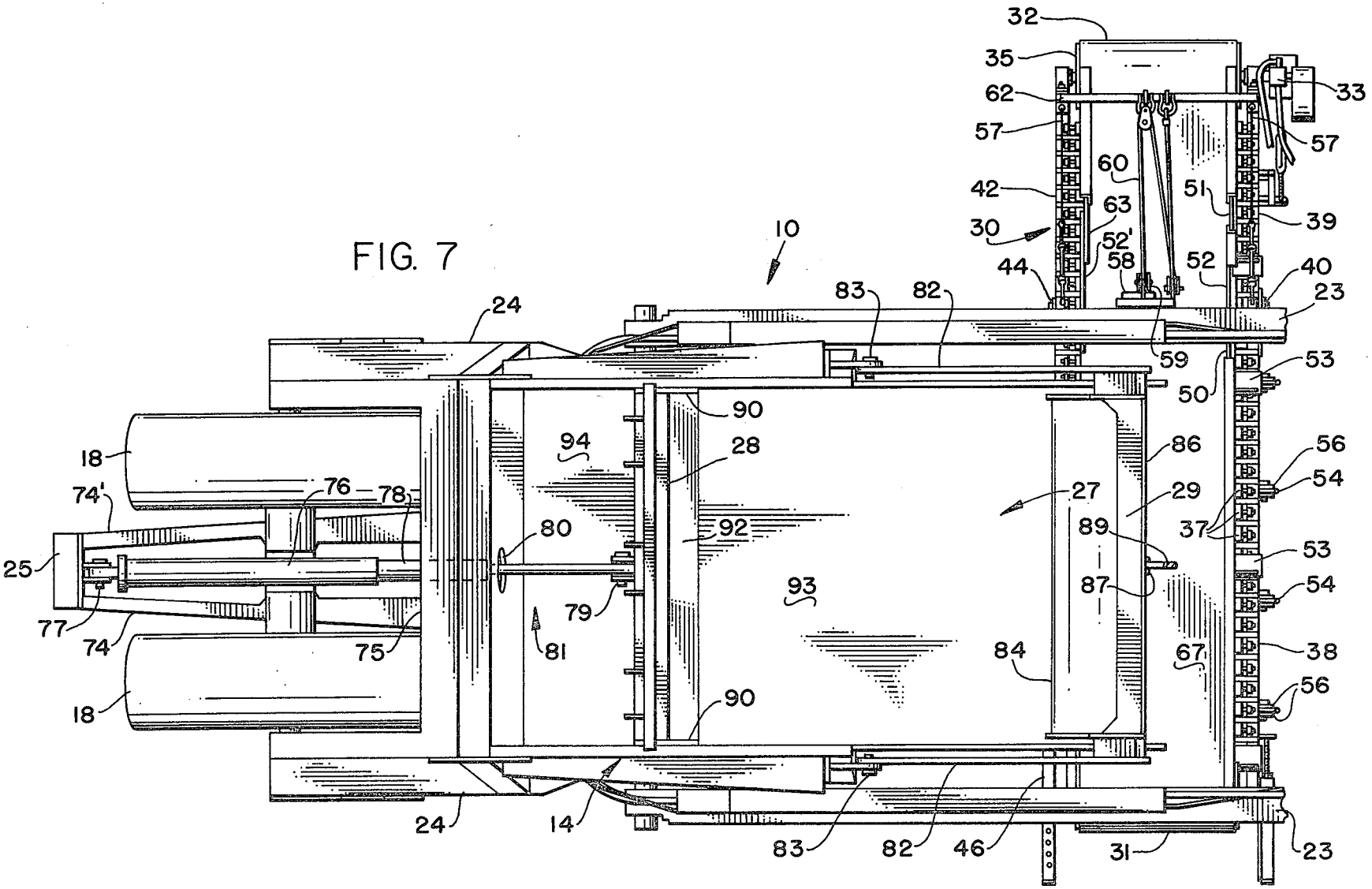

As best seen in FIG. 7, the rear bumper 25 is supported by a pair of rearwardly converging beam members 74, 74' which are rigidly affixed to a vertical support member 75. Support member 75 is tied to the main spar 24, while a hydraulic cylinder 76 is pivotally affixed to the bumper at 77. The piston 78 of the cylinder assembly is affixed at bracket 79 to the movable wall 28. Aperture 80 formed through support 75 telescopingly receives the piston therethrough.

Looking again to the details of FIG. 5, the vertically movable bulkhead 29 is seen to be in the form of a clam shell, having the upper opposed marginal edges thereof attached to a pair of spaced arms 82, with the arms being pivotally mounted to the side walls of the container at pivot point 83. The bottom edge portion 84 of the clam shell is pivoted into a position located rearwardly of a ledger plate 85. Curved wall 86 of the clam shell forms the forward wall of the container. Bracket 87 is affixed to the outer and forward clam shell wall and then to the free end of a hydraulically actuated bell crank 88 by means of a link 89.

Vertical upward motion of the door 29 is brought about by counterclockwise pivotal movement of the clam shell and thereby enlarges the outlet opening 129 to increase the flow of padding material therethrough. Hence movement of the clam shell is analogous to the operation of a valve means.

Horizontally movable wall 28 includes the illustrated spaced apart side portions 90, each of which slidably engage the opposed side walls of the container so that a minimal amount of padding material is lost therebetween. Horizontal web 92 preferably is spaced slightly above floor 93 and effectively prevents any appreciable flow of padding material therebetween. Numeral 94 illustrates a portion of the floor which presently lies without the container.

In FIG. 6, the ground 95 surrounds a ditch 96 within which a pipe 97 has been placed. Padding material 98 covers the pipe and prevents damage thereto. Often, padding material will be placed both above and below the pipe, sometimes requiring two trips along the ditch by the machine.

In operation, the clam shell valve or outlet is closed so that the lower edge portion 84 thereof engages the floor 93 of the container. The rear wall is moved to an extreme rearward position away from the clam shell to thereby provide a large upwardly opening container through which suitable padding material can be charged through inlet 27.

A driver is seated at 20 and pilots the machine so that the delivery end 32 of the conveyer will discharge padding material into a ditch 96, thereby covering a pipe 97 with several inches of finely divided material. The material insulates the outer peripheral surface of the pipe from subsequent injury.

An operator seated at console 72 controls the operation of members 28, 29, and 30. The operator also can communicate with the driver, thereby effectively controlling the prime mover section so that its speed and position relative to the ditch is maintained under satisfactory operation. The console enables the operator to control the action of the rear bulkhead so as to maintain an ample supply of padding material flowing through the outlet, as well as controlling the speed of the conveyer. One interesting aspect of the present invention is that the speed of the conveyor can be regulated to compensate for changes in driver speed in such a manner to maintain a constant depth of the padding material within the ditch.

Another unexpected attribute of the present invention is that the conveyor speed can be reduced to zero, whereupon padding material will continue to flow through the outlet onto the conveyer until the level thereof reaches the lower end portion 84 of the clam shell, whereupon further flow of padding material is automatically or inherently discontinued. Accordingly, while padding a pipe, should the driver unexpectedly stop the vehicle, the operator merely slows the conveyer speed to a stop and leaves the clam shell in its last optimum position. As the driver resumes travel, the operator can again start the conveyor moving at a slower speed and progressively increase the conveyer speed until the accumulated padding material has been satisfactorily disposed of and placed within the ditch.

In order to transport the machine along private roads, the winch 58 is engaged, thereby folding the marginal portion 39 of the conveyer against the side of the machine. This expedient greatly reduces the effective width of the machine, however, the width remains excessive for travel along a highway.

When it is desired to transport the machine along public roadways, it is necessary to further reduce the width of the machine. For this reason, it is desirable that the entire conveyer system be disconnected therefrom and transported on a separate trailer. The conveyer is easily removed from the machine by removing the pins at 56 and 64.

Removal of the four pins at 56 enables the beam 38 to be pivoted downwardly onto a support block or the like, or directly onto a trailer. Next, the four pins at 64 or 66 are removed and the beam 46 set down on a suitable support means. Block 61 is next removed, and cable ends 57 unhooked. The hydraulic hoses are then rapidly removed from the machine and may be transported along with the conveyer.

Since the downwardly disposed lugs 64 are an integral part of the floor structure 65, and the floor structure 65 is tied into the walls and into the opposed spars 23, it stands to reason that beam 46 is rigidly tied to the superstructure of the container in a manner which imparts the conveyer with a pivotal motion respective to the pivot pins at 64. Beam 38 is tied to the superstructure by means of the turnbuckles 64 so that the angular dispostion of surface 57 can be adjusted respective to the remainder of the machine.

I claim:

1. A modified scraper machine for distributing padding material within a previously dug ditch, comprising:

a prime mover, a distributing section including a container for holding padding material, a conveyor means for transferring material from said container into a ditch; means, including said prime mover, for propelling said container along the surface of the ground, such that the conveyor means can follow a path of travel which is parallel to a previously dug ditch;

said container means having a bottom, opposed side walls, a movable rear wall, and a movable front wall; said side walls being affixed to and upwardly extending from said bottom, said movable rear wall including means by which it can be moved horizontally towards said front wall, said front wall including means by which it can be moved vertically respective to said bottom and side walls, thereby forming an outlet of controllable area therebetween;

said bottom, opposed side walls, movable rear wall, and movable front wall form an upwardly opening container into which padding material can be charged in order to store padding material within said container means;

frame members having opposed ends by which said conveyor means is supported normally to the direction of travel of the machine, and in underlying relationship respective to said outlet such that padding material which may flow through said outlet is received by said conveyor means;

means by which said frame members are removably supported from said distributing section such that said conveyor means is disposed adjacent to said outlet in a position to receive padding material which may flow therethrough, and such that said conveyor means can be detached for transporting purposes;

so that padding material can be charged into said container, said front wall can be raised to form an outlet, said rear wall can be moved towards said front wall to force the material through said outlet, where it is received by said conveyor and transported into a ditch.

2. The padding machine of claim 1 wherein said front wall has a top edge spaced from a bottom edge thereof, and side walls which slidably engage the side walls of said container, said front wall being connected to a lever, with said lever having means forming a journal at a position spaced from said wall, so that said wall can be pivoted about said journal to thereby move vertically respective to said bottom.

3. The padding machine of claim 1 and further including a hydraulically actuated cylinder assembly, means by which said cylinder assembly is connected to said machine and to said movable rear wall to provide for the stated horizontal movement thereof.

4. The padding machine of claim 1 wherein said conveyer is an endless belt having an upper surface which underlies said outlet;

a ledger plate mounted at said outlet in overlapping relationship respective to said endless belt, so that padding material can flow through said outlet and onto said upper surface of said endless belt.

5. The padding machine of claim 1 wherein said conveyor means is an endless belt having a roller disposed at each end thereof, about which said belt is guidably received;

said rollers being supported by two spaced apart longitudinally disposed parallel frame members;

hinge means between said rollers by which a marginal length of said frame can be folded in a pivotal manner, thereby effectively shortening the width of the padding machine.

6. The padding machine of claim 1 wherein said front wall has a top edge spaced from a bottom edge thereof, and side walls which slidably engage the side walls of said container, said front wall being affixed to a lever, said lever includes means forming a journal at a position spaced from said wall, so that said wall can be pivoted about said journal to thereby move vertically respective to said floor;

said conveyor being an endless belt having an upper surface formed thereon which is mounted in underlying relationship respective to said outlet;

a ledger plate mounted to said machine and connecting said outlet to said upper surface of said endless belt.

7. The padding machine of claim 1 and further including a hydraulically actuated cylinder, means by which said rear wall is affixed to said hydraulically actuated cylinder such that said cylinder, when actuated, provides for said horizontal movement of said rear wall;

said conveyor being an endless belt having an upper surface which underlies said outlet;

a ledger plate underlying said outlet so that padding material can flow through said outlet and onto said endless belt.

8. The padding machine of claim 1 wherein said conveyer means is an endless belt having a roller disposed at each end thereof, means by which said belt is guidably received about said rollers; means imparting rotational motion into said rollers to cause movement of said belt;

said frame members including spaced parallel members, means by which said rollers are journaled to said opposed ends of said frame members such that said frame members are disposed parallel to the path of travel of said endless belt.

9. The padding machine of claim 8, and further including hinge means by which said frame members can be folded to thereby effectively shorten the width of the padding machine.

10. A transporting and distributing machine for padding pipe placed within a ditch, said machine comprising a modified scraper machine in the form of a ground supported vehicle having a container into which padding material can be placed; means for guidably propelling said vehicle along a path of travel which is parallel to the ditch;

said container having opposed sidewalls affixed to a floor, and a rear and a front wall;

means mounted said rear wall respective to said sidewalls and floor such that said rear wall is movable towards said front wall to thereby force any material therebetween towards said front wall;

means mounting said front wall in sealed relationship respective to said side walls and in a vertically movable manner respective to said floor to thereby form a variable outlet through which padding material can flow;

a conveyor means, mount means by which said conveyor means is positioned in underlying relationship respective to said outlet, a marginal length of said conveyor extending laterally away from said machine; said floor having a marginal edge portion which extends through said outlet and is superimposed over a marginal lateral edge portion of said conveyor; a prime mover for imparting conveying motion into said conveyor;

means controlling the relative position of said rear wall respective to said front wall, means controlling the relative position of said front wall respective to said floor, and means controlling the speed of said conveyor motion;

said conveyor means comprising and endless belt having a roller disposed at each end thereof, means by which said belt is guidably received about said rollers; means imparting rotational motion into said rollers to cause movement of said belt;

spaced parallel frame members having opposed ends, means by which said rollers are journaled to said opposed ends of said frame members such that said frame members are disposed parallel to the path of travel of said endless belt;

means by which said frame members are removably supported from said distributing section such that said endless belt is disposed adjacent to said outlet in a position to receive padding material which may flow therethrough, and such that said conveyor means can be detached for transporting purposes.

11. The machine of claim 10 and further including hinge means by which said frame members can be folded to thereby effectively shorten the width of the padding machine.

12. The machine of claim 10 and further including a hydraulically actuated cylinder, means by which said rear wall is affixed to said hydraulically actuated cylinder such that said cylinder, when actuated, provides for said horizontal movement of said rear wall;

said endless belt having an upper surface which underlies said outlet;

a ledger plate underlying said outlet so that padding material can flow from said container, through said outlet, and onto said endless belt, whereupon the endless belt transports the padding material laterally away from the container.

13. The machine of claim 10 and further including a hydraulically actuated cylinder, means by which said rear wall is affixed to said hydraulically actuated cylinder such that said cylinder, when actuated, provides for said horizontal movement of said rear wall;

a ledger plate underlying said outlet so that padding material can flow through said outlet and onto said endless belt;

hinge means by which said frame members can be folded to thereby effectively shorten the width of the padding machine.

14. The machine of claim 13 wherein said ledger plate is mounted at said outlet in overlapping relationship respective to said endless belt, so that padding material can flow through said outlet and onto said upper surface of said endless belt.

15. The machine of claim 10 wherein a ledger plate is mounted at said outlet in overlapping relationship respective to said endless belt, so that padding material can flow through said outlet and onto said upper surface of said endless belt.

* * * * *